United States Patent [19]

Rumman

[11] Patent Number: 4,879,800

[45] Date of Patent: Nov. 14, 1989

[54] METHOD OF PRODUCING A COLUMNAR SUPPORT STRUCTURE

[76] Inventor: Sally H. Rumman, P.O. Box 39, Sylvania, Ohio 43560

[21] Appl. No.: 225,896

[22] Filed: Jul. 29, 1988

[51] Int. Cl.[4] ..... B23P 11/02

[52] U.S. Cl. ..... 29/450; 29/155 C; 108/156; 211/135; 211/189; 248/188; 428/12; 446/114; 446/116; 446/482

[58] Field of Search ..... 29/428, 450, 150, 155 C, 29/433, 155 R, 235; 428/12, 20; 256/DIG. 5; 108/156, 153, 157, 159; 248/188; 446/114, 116, 124, 482; 211/135, 189

[56] References Cited

U.S. PATENT DOCUMENTS

| | | | |
|---|---|---|---|
| 1,197,025 | 9/1916 | Hawkins | 108/156 |
| 1,262,339 | 4/1918 | Hathorne | 248/188 |
| 1,444,569 | 2/1923 | Starkweather | 248/188 |
| 2,235,290 | 3/1941 | Exline et al. | 108/159 |
| 2,439,501 | 4/1948 | Yelkin | 29/235 |
| 2,933,193 | 4/1960 | De Mattia | 211/187 X |
| 3,858,530 | 1/1975 | Jaffee et al. | 211/187 |
| 3,932,047 | 1/1976 | Crossan | 108/156 X |
| 4,058,882 | 11/1977 | Muckelrath | 29/445 X |
| 4,062,101 | 12/1977 | La Custa | 29/235 X |
| 4,440,812 | 4/1984 | Norrid | 428/12 |

*Primary Examiner*—Charlie T. Moon

*Attorney, Agent, or Firm*—Marshall & Melhorn

[57] ABSTRACT

A method of manufacturing a support structure, or leg, for a piece of furniture such as a table or the like. A blank of planar sheet material is provided with a rectangular opening adjacent one end and bent about an axis extending through the opening to form the support structure of the invention. The opening is sized such that after bending an edge of a table top is inserted in the opening and supported thereby. A plurality of the support structures, or legs, are attached to the table top to provide necessary support.

1 Claim, 1 Drawing Sheet

METHOD OF PRODUCING A COLUMNAR SUPPORT STRUCTURE

BACKGROUND OF THE INVENTION

The present invention relates to a method for manufacturing a support structure for furniture or accessory items, and more particularly to a simple and economical method for manufacturing legs for table shelves, and the like.

Table legs are made of various materials and manufactured in an almost endless variety of shapes and sizes, limited only by style and intended purpose. Such legs are commonly attached to the edge or bottom surface of a table top by means of suitable fasteners such as screws, nails, staples, adhesives, or the like. Although fasteners of this type have proven to be very successful, they do tend to loosen in time and require repair or replacement. The use of fasteners in the manufacturing process to attach legs to a table top, as mentioned, is time consuming and together with the cost of the parts, contribute to the overall cost of the product. Any reduction in manufacturing cost would benefit both the consumer and manufacturer.

Some furniture styles, such as modern or contemporary, are characterized by smooth simplistic lines. The styling affords the use of a leg structure for tables and the like having a simple and pleasing overall design appearance as compared to the exceptionally ornate and elaborate designs required with other styles. The more ornate styling generally necessitates the use of expensive woods or molded parts which increase the cost of manufacture.

SUMMARY OF THE INVENTION

The present invention relates to an easy and economic method for manufacturing support structures, such as legs for tables and the like. The invention is particularly suitable for, although not limited to, the manufacture of tables of modern or contemporary styling. The support structure is fabricated from readily available substantially rigid sheet material, such as metal, plastic, or other synthetic materials, contributing to the low cost of manufacture.

In accordance with the invention, a blank of sheet material is provided with a rectangular opening of predetermined size, cut or punched through an upper portion thereof. The sheet is then bent by any suitable means about an axis intersecting the opening, forming the support structure of the invention. The size of the opening and the axis of bending is chosen to provide a suitable supporting surface for an edge of a table top. A plurality of the support structures, or legs, are formed and attached, by friction, for example, to the table top providing support thereto.

Although the support structure of the present invention does not require the use of the previously mentioned attaching means, such as screws, nails, staples, adhesives, or the like, to secure the legs to the table top, such means may be used if desired.

Therefore, it is a primary object of the present invention to manufacture a support structure for furniture, such as a table, by a new and economic method.

Another object of the present invention is to manufacture such a structure from sheet material that is readily available and relatively inexpensive.

Another object of the present invention is to manufacture such a structure that is easily formed and provides a firm and long-lasting attachment to an associated table top.

Still another object of the present invention is to provide such a structure that does not require additional attaching means.

BRIEF DESCRIPTION OF THE DRAWINGS

The above, as well as other objects and advantages of the present invention, will become readily apparent to one skilled in the art from the following detailed description of the preferred embodiment of the invention when considered in the light of the accompanying drawings, in which.

DESCRIPTION OF THE PREFERRED EMBODIMENT

In accordance with the present invention there will now be described a simple and relatively inexpensive method for manufacturing support structures, or legs, for tables or the like. As previously mentioned, the method of the invention is best suited for the manufacture of tables of modern or contemporary styling, due to the relatively simple designs usually associated with such styling.

Figure 1:
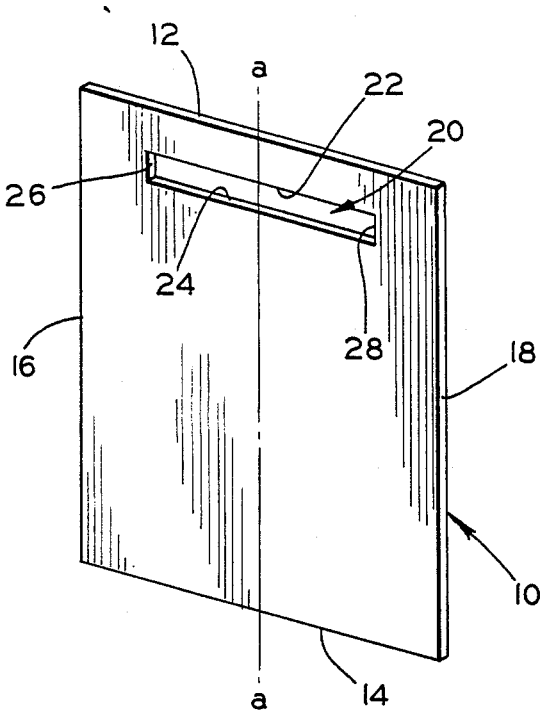
FIG. 1 is a perspective view of a blank of rectangular sheet material having a slot formed therein for use in the method according to the present invention.

Referring now in detail to the drawings, there is illustrated in FIG. 1, a blank of rectangular sheet material, generally designated 10, that will be utilized to form a support structure or table leg, in accordance with this invention. Although the support structure is illustrated as a support for a table top, it is appreciated that the support can readily be adapted for supporting one or a plurality of speced apart shelves. While the invention will be described in connection with the rectangular sheet depicted in the drawings, it should be understood that the invention is not restricted thereto, but may also include other geometric shapes as well. The sheet 10 is generally planar and of uniform thickness and includes a top edge 12, a bottom edge 14 and associated spaced apart side edges 16 and 18. The top edge 12 and bottom edge 14 represent the top and bottom, respectively, of the support structure in its functional position. The sheet can be fabricated of metal, such as steel or aluminum, for example, or plastics or other various synthetic materials. The type of material utilized is dictated by personal preference and style of furniture being constructed. It should also be substantially rigid to be able to adequately support the associated table top.

The blank of sheet material 10 is typically cut to the desired size from larger sheets or rolls of material in any convenient manner, such as stamping, in a continuous operation. If the material utilized to form the blank is conducive to mold forming, such as plastics, the sheet may simply be formed to the desired size and shape in a molding operation. After the blank of sheet material is produced, a rectangle-like opening or slot 20 is formed adjacent the top 12 of the sheet 10 by any suitable means such as milling, hole punching, drilling, etc. The slot 20 is defined by a top edge portion 22, a bottom edge portion 24 and associated spaced apart side edge portions 26 and 28. It is noted that the edge portions 22 and 24 are parallel to one another and to the bottom edge 14. The bottom edge portion 24, which will ultimately be employed for supporting an edge of a table top, is spaced a predetermined distance from the top edge portion 22, as will be more fully explained hereafter. Once the opening 20 is cut from the sheet 10, the outer edges of the sheet and the inner edges of the opening may be finished by grinding, sanding, polishing, or any other suitable means to provide a smooth finish to the edges.

Figure 2:
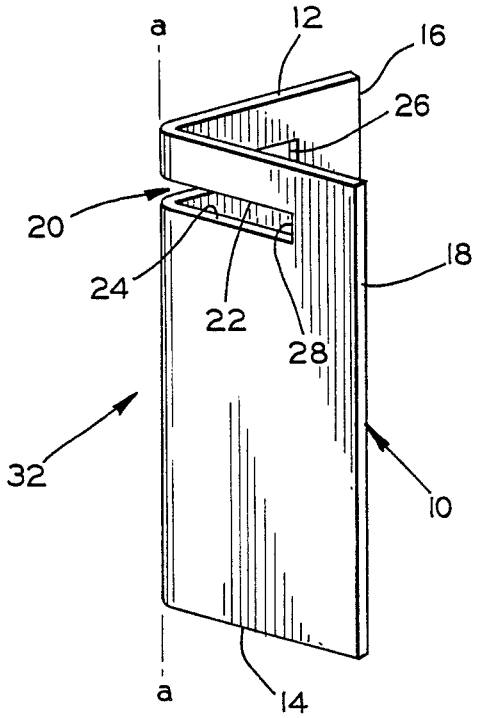
FIG. 2 is a perspective view of the blank illustrated in FIG. 1 after being formed in the method according to the present invention into a shape suitable for supporting a table top.

As shown in FIGS. 1 and 2, the sheet 10 is bent about a central longitudinal axis a-a into a generally V-shaped supporting structure, generally designated 32. The axis a-a intersects the opening 20 and is disposed substantially normal to the bottom edge 14 to provide a square base after forming. Bending of the sheet 10 can be effected by the use of conventional pressing dies, press brake, or other suitable means. A typical die or press tool (not shown) generally consists of two cooperating members for forming the sheet material. The matching surfaces of the members are provided with the shape desired to impart to the material being processed. In a typical operation, utilizing the above described process, the sheet 10 is placed in position between the members while the press is open. Upon actuation of the press, one of the cooperating members is forced into engagement with the sheet 10 shaping it against the other cooperating member, transforming the shape of the sheet 10 to the shape of the cooperating members. In this process, the sheet 10 with the slot 20 is maintained in a smooth, unwrinkled, and uniform thickness. Although the method just described for bending the sheet material to the desired shape performs admirably, it should be appreciated, that the form of the invention is not limited thereto, and other methods may be employed that perform as well. Once the above fabricating process is established, it is a simple matter to economically manufacture a plurality of support structures 32 by following the aforesaid procedures.

Figure 3:
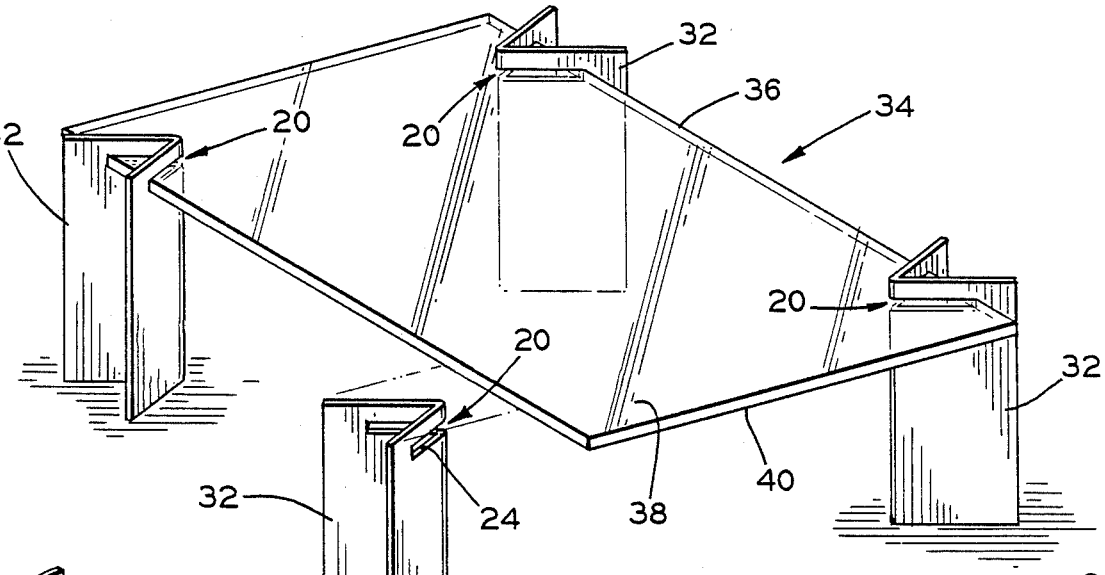
FIG. 3 is a perspective view of an assembled table utilizing a plurality of the support structures illustrated in FIG. 2 according to the present invention.
Figure 5:
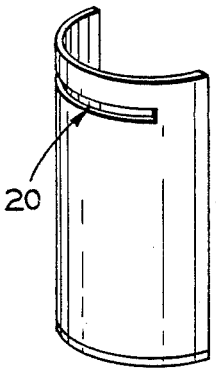
FIG. 5 is a perspective view similar to FIG. 2 illustrating an alternate support structure produced according to the present invention.

Referring now to FIG. 3, there is illustrated a table 34, comprising a generally planar top member 36 supported in slots 20 of the support structures or legs 32 of the invention. A plurality of the legs are employed and strategically placed for proper support. The top 36 is of a predetermined thickness and comprises an upper supporting surface 38 and a lower surface 40 substantially parallel thereto. As previously mentioned, the opening 20 includes a bottom edge portion 24 for supporting an outer edge of a table top. The bottom edge portion 24 is parallel to the bottom edge 14 of the leg 32 to provide a support surface for the table top that is parallel to the floor or surface supporting the leg. As also mentioned, the top edge portion 22 of the opening 20 is spaced a predetermined distance from the bottom edge portion 24. This distance is determined by the thickness of the top being supported and can vary from one table to another. The distance between the top and bottom edge portions 22 and 24 of the slot 20 is generally slightly greater than the thickness of the top 36 to provide a relatively snug friction fit between the slot 20 and the upper and lower surfaces 38 and 40 of the top 36. Thus, the present invention is advantageous in that the table 34 does not require any special fasteners or attachment means to attach the legs 32 to the table top 36, substantially reducing material and labor costs. It should be appreciated that without special fasteners, the table can be easily disassembled and set up at another location, if desired. However, the legs 32 may be adhesively or otherwise attached to the top 36 to provide a more permanent structure.

Figure 4:
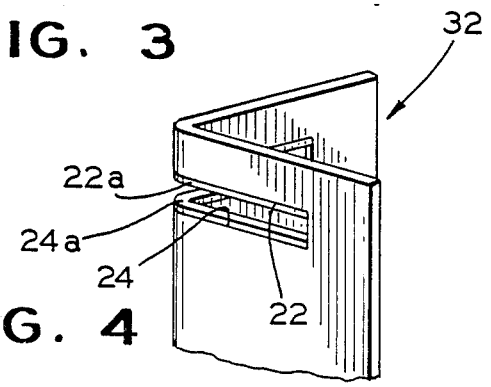
FIG. 4 is a fragmentary perspective view of the upper portion of the support structure of FIG. 2 illustrating a modification thereof.

In an alternative embodiment, the top and bottom edge portions 22 and 24 can be equipped with elastomeric strips or pads **22*a* and 24*a*, respectively, as illustrated in FIG. 4, to yieldably grip the edge of the table top and provide increased structural stability thereto. The pads also prevent scratching or marring of the surface of the table top when installing or removing the legs. If desired, only one of the pads 22*a* or 24*a* may be employed to provide increased stability. It will be appreciated that when employing one or both of the pads, the distance between the top and bottom edge portions 22 and 24** should be increased to accommodate the additional thickness of the pads.

The table top 36 can be made of metal, wood, marble, plastics, glass, or the like. The number of the legs 32 and their location on the table 34 can be varied in accordance with the manner in which the table is designed. It will be understood that the height of the table 34 is generally the distance between the top edge portion 22 of the slot 20 and the bottom edge portion 14 of the leg 32. One or more shelves may be added to the table assembly by simply forming the respective slots in the blank of sheet material for each shelf desired at the time of fabrication.

Likewise, as previously mentioned, the present invention is not limited to a support structure for a table top but also has utility as a support structure for shelving or the like. In this respect, each support structure is fabricated to a predetermined length and provided with a plurality of spaced slots for receiving the shelves desired.

In FIGS. 2 and 3, the supporting leg 32 has been shown and described as being V-shaped in cross-section, but it is to be understood that the leg 32 may be arcuate or C-shaped in cross-section, as shown at 32' in FIG. 4, or any other shape according to the design or style of the furniture being manufactured. If desired, the bottom of the leg 32 can be fixed with a rubber cushion pad or wheel castors to adapt the leg 32 into various conditions and environment. The table top 36 can be formed in any variety of shapes, sizes and thicknesses, limited only by design and practicality.

It is to be understood that the form of the invention herewith shown and described is to be taken as an illustrative embodiment only of the same, and that various changes in the shape, size and arrangement of parts may be resorted to without departing from the spirit of the invention.

What I claim is:

1. A method of producing an article of furniture having at least one columnar support structure comprising the steps of:

(a) providing a top having generally parallel upper and lower planar surfaces and a predetermined thickness;

(b) providing a blank of planar sheet material having a first upper edge and a second lower edge joined by opposed side edges;

(c) forming at least one rectangular opening in said blank, said opening including opposed first and second sides disposed parallel to the lower edge, and spaced apart a predetermined distance slightly greater than the thickness of said top;

(d) providing an axis on said blank intersecting said opening and normal to the second lower edge, the axis dividing said blank into first and second portions;

(e) bending said blank about said axis effecting relative displacement of the first and second portions and said opening therein thereby producing a support structure having a convex side and a concave side;

(f) providing said upper and lower sides of said opening with elastomeric pads; and (g) assembling the columnar support structure on one edge of said top whereby the top is inserted into yieldably gripping engagement with said pads in the rectangular opening in the convex side of the support structure and supported on the second side thereof.

* * * * *